US011377841B2

(12) United States Patent
Kurosawa

(10) Patent No.: US 11,377,841 B2
(45) Date of Patent: Jul. 5, 2022

(54) JUNCTION STRUCTURE OF PRESTRESSED CONCRETE (PC) COLUMN AND STEEL BEAM

(71) Applicant: KUROSAWA CONSTRUCTION CO., LTD., Chofu (JP)

(72) Inventor: Ryohei Kurosawa, Tokyo (JP)

(73) Assignee: KUROSAWA CONSTRUCTION CO., LTD., Tokyo (JP)

( * ) Notice: Subject to any disclaimer, the term of this patent is extended or adjusted under 35 U.S.C. 154(b) by 22 days.

(21) Appl. No.: 17/117,056

(22) Filed: Dec. 9, 2020

(65) Prior Publication Data

US 2021/0198887 A1 Jul. 1, 2021

(30) Foreign Application Priority Data

Dec. 25, 2019 (JP) ..... JP2019-234442

(51) Int. Cl.
*E04B 1/24* (2006.01)
*E04B 1/30* (2006.01)
*E04B 1/21* (2006.01)

(52) U.S. Cl.
CPC ..... *E04B 1/2403* (2013.01); *E04B 1/215* (2013.01); *E04B 1/30* (2013.01);
(Continued)

(58) Field of Classification Search
CPC ..... E04B 1/2403; E04B 1/215; E04B 1/30; E04B 2001/2415; E04B 2001/2418; E04B 2001/2466; E04B 2001/2406; E04B 1/58
See application file for complete search history.

(56) References Cited

U.S. PATENT DOCUMENTS 3,722,159 A * 3/1973 Kessler ..... E04B 1/215 52/283
5,688,069 A * 11/1997 Hoshino ..... E04B 1/215 403/339

(Continued)

FOREIGN PATENT DOCUMENTS

JP 2009-114742 A 5/2009
JP 5521105 B1 6/2014

(Continued)

OTHER PUBLICATIONS

Notice of Reasons for Refusal dated Jun. 9, 2020, in Japanese Patent Application No. 2019-234442.

*Primary Examiner* — Rodney Mintz
(74) *Attorney, Agent, or Firm* — SGPatents PLLC

(57) ABSTRACT

A structure enables free and reasonable designing of a cross section of an end of a steel beam in accordance with bending stress and a housed state of a PC steel, thereby providing an economic and reasonable building as a whole. A beam end block includes end plates and an anchor plate. The end plates are fixed at an end surface of an H-section steel in a direction substantially perpendicular to the longitudinal direction of the beam. The anchor plate is fixed to the H-section steel separately from the end plates, on a side opposite to a column, in a direction substantially perpendicular to the longitudinal direction of the beam. An end of the steel beam has an upper part and a lower part. The upper part protrudes toward the column more than the lower part and is mounted on a cogging. The beam end block has a height dimension larger than the height dimension of the H-section steel and has a lower end that is disposed at substantially the same height as a lower end of a side surface of the cogging facing the lower part of the end of the steel beam.

2 Claims, 3 Drawing Sheets

(52) U.S. Cl.
CPC ..... *E04B 2001/2415* (2013.01); *E04B 2001/2418* (2013.01); *E04B 2001/2466* (2013.01)

(56) References Cited

U.S. PATENT DOCUMENTS

| | | | | |
|---|---|---|---|---|
| 5,827,006 | A * | 10/1998 | Hoshino | E04B 1/215 403/339 |
| 9,534,411 | B2 * | 1/2017 | Kurosawa | E04H 12/16 |
| 9,765,521 | B1 * | 9/2017 | Abbas | E04B 1/22 |
| 10,378,197 | B2 | 8/2019 | Kurosawa et al. | |
| 10,378,199 | B2 * | 8/2019 | Calderon Uriszar-Aldaca | E04B 1/1912 |
| 10,837,173 | B2 * | 11/2020 | Yin | E04B 1/04 |
| 11,111,664 | B2 * | 9/2021 | Kurosawa | E04C 3/293 |
| 11,225,786 | B2 * | 1/2022 | Yu | E04B 1/215 |
| 2015/0330095 | A1 * | 11/2015 | Kurosawa | E04B 1/98 52/741.3 |
| 2017/0175376 | A1 * | 6/2017 | Calderon Uriszar-Aldaca | E04B 1/215 |
| 2018/0127966 | A1 | 5/2018 | Kurosawa et al. | |
| 2019/0226206 | A1 * | 7/2019 | Yin | E04B 1/215 |
| 2021/0079643 | A1 * | 3/2021 | Kurosawa | E04C 5/10 |
| 2021/0189726 | A1 * | 6/2021 | Kurosawa | E04H 9/025 |
| 2021/0214931 | A1 * | 7/2021 | Yu | E04C 3/34 |
| 2021/0395996 | A1 * | 12/2021 | Qu | E04B 1/2403 |

FOREIGN PATENT DOCUMENTS

| | | |
|---|---|---|
| JP | 6171070 B1 | 7/2017 |
| JP | 6749673 B1 | 9/2020 |

* cited by examiner

JUNCTION STRUCTURE OF PRESTRESSED CONCRETE (PC) COLUMN AND STEEL BEAM

Priority is claimed on Japanese Patent Application No. 2019-234442 filed on Dec. 25, 2019, the content of which is incorporated herein by reference.

BACKGROUND OF THE INVENTION

Field of the Invention

The present invention relates to a junction structure of a concrete column and a steel beam or a beam of steel structure.

Description of the Related Art

The inventor of the present invention together with other(s) have developed some of such junction structures between a concrete column and a steel beam, which have been disclosed and known in the art.

A first known art of the junction structure is a building structure including a PC column and a steel beam. An end plate and an anchor plate are provided at an end of the steel beam, and this end is mounted on a cogging or corbel provided to the PC column. The PC column is joined by binding juncture such that PC steels are vertically arranged in the PC column and are tensioned and anchored. Other PC steels are horizontally penetrated in a column-beam junction and are tensioned and anchored to the anchor plate. Thus, the PC column and the steel beam are integrally joined by binding juncture to form a column-beam junction structure (Patent Literature 1: JP-B-5521105).

In the junction structure of the first known art, the beam uses a steel beam so as to be light in weight, and a cogging is integrally provided to the PC column. This structure provides an extensive space with a wide span or with a distance between columns and achieves a reasonable structure that can be used in high-rise or super high-rise buildings. The PC column and the steel beam are tensioned and anchored to each other with the PC steels in the state in which the end of the steel beam is mounted on the cogging formed to the PC column. This jointed state is reliably maintained without occurring coming off and falling of the steel beam from the PC column even in case of a massive earthquake. Moreover, the end plate and the anchor plate, which are provided to the beam end, greatly improve flexural rigidity of the beam end to be higher than that of a conventional steel beam. Thus, a beam end anchored part is prevented from being damaged, and bending stress is smoothly transmitted from the beam to the column. A space between the end plate and the anchor plate is filled with a filler material, whereby bearing stress acting on the anchor plate is greatly reduced. This enables economic design by thinning the plate. In this manner, a reasonable and safe junction structure is obtained although a wide span is provided, and moreover, it is possible to install the steel beam in the independent state without using a timbering, only by mounting the end of the steel beam on the cogging in construction. As a result, a structure having good installation workability, which greatly reduces labor and cost for installation, is provided.

A second known art is a jointing method based on the first known art. In this jointing method, a joint-separation control condition is specified in such a manner that joint separation at a structure joint portion is inhibited in a case of a moderate earthquake or a weaker earthquake, but the joint separation is allowed to proceed in a case of a large earthquake so that the steel beam will not yield (Refer to Patent Literature 2: JP-B-6171070 corresponding to U.S. Pat. No. 10,378,197 B2).

With this jointing method, in a case of a moderate earthquake or a weaker earthquake, joint separation does not occur at a structure joint portion between a column and a beam, and the column and the beam are in a rigid joint state and within elastic ranges to exert aseismatic performance. In a case of a large earthquake, the joint is separated in an elastic state, and the steel beam is rotated to reduce stress acting thereon, whereby the steel beam does not yield, and the undamaged state of the steel beam can be maintained. Thus, after the earthquake, the elastic restoration force of the PC steel closes the separated joint and restores the whole structure, including columns and beams, to the original positions, resulting in no residual deformation remaining. In sum, this jointing method provides a structure with damage-free columns and beams due to elastic separation of the structure joint portion or of a part at which the column and the beam are joined by PC binding juncture.

CITATION LIST

Patent Literature

Patent Literature 1: Patent Literature 1: JP-B-5521105

Patent Literature 2: JP-B-6171070 corresponding to U.S. Pat. No. 10,378,197 B2

SUMMARY OF THE INVENTION

According to Patent Literature 1, JP-B-5521105, the cross section of the steel beam mounted on the cogging of the PC column is uniform in the whole length, which structure facilitates end processing and installation of the steel beam. On the other hand, in consideration of large bending stress occurring at a beam end due to an earthquake load in a rigid frame structure, multiple PC steels should be arranged in the vertical direction at the column-beam junction, for example, PC steels should be arranged in multiple stages. This requires enlarging a beam height of the beam end in order to suitably house the column-beam junction, and in the state in which the cross section of the steel beam is uniform in the whole length, increase in the beam height in the whole length is unavoidable. Increasing the beam height causes increase in weight of the beam and in cost. Bending stress due to an earthquake load hardly occurs in the middle of a beam, and it is not necessary to enlarge the cross section in the middle of the beam. In view of this, increasing the beam height in the whole length provides a structure that is uneconomic and unreasonable.

In Patent Literature 1, JP-B-5521105, the whole cogging that is provided to the PC column is disposed under the steel beam. Exposure of a cogging is not preferable in design, and therefore, a ceiling is installed under the cogging to hide the cogging in most cases. In these cases, the installation line of the ceiling is low compared with a case of providing no cogging. In addition, in the state in which the beam height is increased as described above, the installation line of the ceiling is more lowered, which makes it difficult to effectively use the limited floor height.

In order to satisfy the joint-separation control condition devised in Patent Literature 2, JP-B-6171070 corresponding to U.S. Pat. No. 10,378,197 B2, a distance ds from a lower end of a steel beam to a top end of a slab is preferably large.

The distance ds is the total of a beam height "H" and a slab thickness "a" (ds=H+a). In consideration that the slab thickness "a" is difficult to increase, in order to increase the distance ds, it is necessary to increase the beam height "H", resulting in increase in cross section in the whole length of a beam. Also, in JP-B-6171070 corresponding to U.S. Pat. No. 10,378,197 B2, the whole cogging that is provided to the PC column is disposed under the beam. Thus, also in the case in JP-B-6171070 corresponding to U.S. Pat. No. 10,378,197 B2, the structure is uneconomic and is unreasonable, and the installation line of a ceiling is low.

In view of these problems, an object of the present invention is to provide a structure that enables free and reasonable designing of a cross section of an end of a steel beam in accordance with bending stress and a housed state of a PC steel, thereby providing an economic and reasonable building as a whole.

Another object of the present invention is to reduce dimensions of a protrusion under a beam, of a cogging provided to a column, so as to make an installation line of a ceiling high.

A first aspect of the present application for solving the above problems provides a column-beam junction structure including a concrete column and a steel beam that are integrally jointed to each other. The steel beam includes an H-section steel as a beam main body and a beam end block that is provided at an end of the H-section steel. The steel beam is disposed in a state in which the end is mounted on a cogging provided to a side surface of the column. The beam end block includes an end plate and an anchor plate. The end plate is fixed at an end surface of the H-section steel in a direction substantially perpendicular to the longitudinal direction of the steel beam. The anchor plate is fixed to the H-section steel separately from the end plate, on a side opposite to the column, in a direction substantially perpendicular to the longitudinal direction of the steel beam. The end of the H-section steel includes an upper part and a lower part. The upper part protrudes toward the column more than the lower part and is mounted on the cogging. The end plate includes an outer end plate and an inner end plate. The outer end plate is fixed at an end surface of the upper part of the H-steel and faces the side surface of the column via a joint. The inner end plate is fixed at an end surface of the lower part of the H-section steel and faces the cogging via a joint. The beam end block has a height dimension larger than the height dimension of the H-section steel. The beam end block has a lower end that is disposed at substantially the same height as a lower end of a side surface of the cogging facing the lower part. The column and the beam end block are penetrated by a PC tendon. The PC tendon is tensioned and anchored to a surface of the anchor plate on a side opposite to the column to perform the integral jointing.

According to a second aspect of the present application, the section steel may be an H-section steel in the column-beam junction structure in the first aspect.

According to a third aspect of the present application, a space between the end plate and the anchor plate may be filled with a filler material in the column-beam junction structure in the first or the second aspect.

The present invention provides the following effects.

1. Since a beam main body at an intermediate part of a beam and a beam end block, are different in structure from each other, a cross section of the beam main body and a cross section of the beam end block can be determined, respectively. Accordingly, it is possible to constitute the beam main body by using the shaped or section steel and to freely set the height of the beam end block in accordance with bending stress at the end of the beam and the number of the PC tendons so that the beam may have necessary flexural rigidity. As a result, the steel beam has an economic and reasonable structure.

2. The upper part protrudes toward the column more than the lower part at the end of the steel beam, and the cogging is disposed under the upper part, which protrudes toward the column, as an internal cogging. This allows making an installation line of a ceiling high to effectively make the most of the floor height.

3. Filling the space between the anchor plate and the end plate with the filler material greatly improves flexural rigidity of the beam end block, thereby making it possible to reduce dimensions of the beam end block.

DESCRIPTION OF THE PREFERRED EMBODIMENTS

Figure 1A:
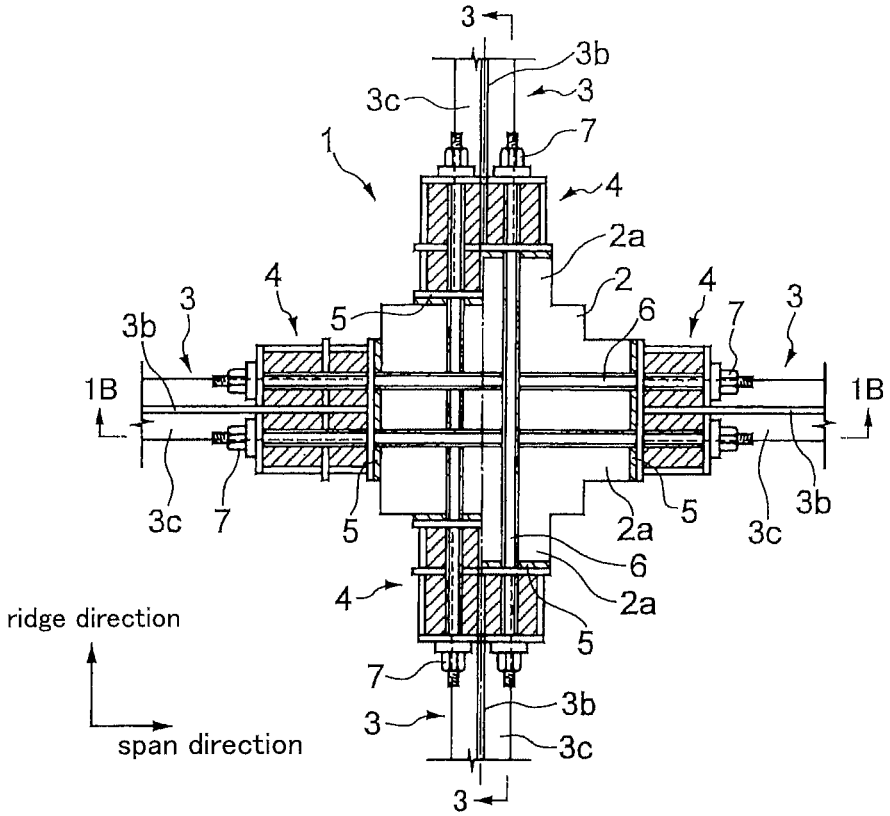
FIG. 1A is a sectional view illustrating an upper 1A-1A cross section and a lower 1A-1A cross section of a column-beam junction structure according to an embodiment of the present application in FIG. 1B.
Figure 1B:
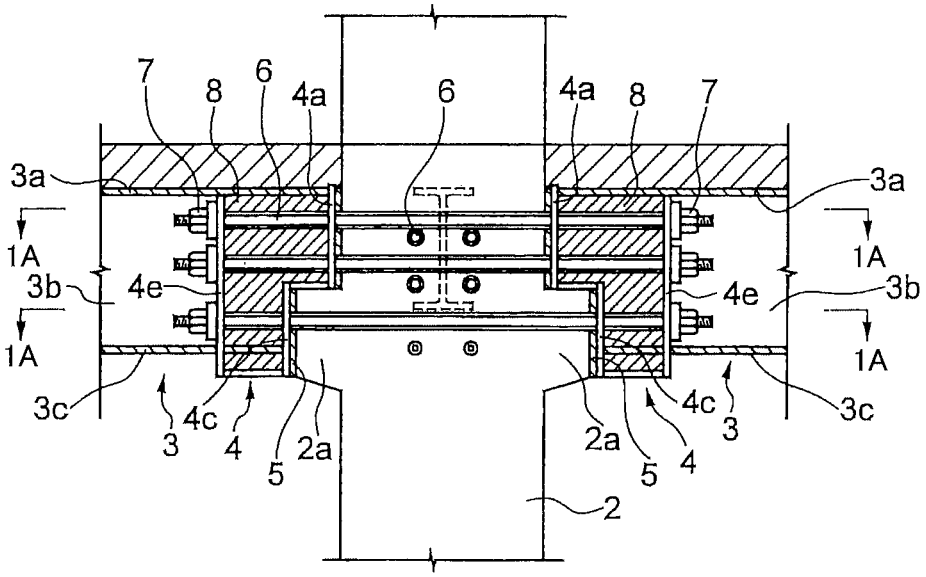
FIG. 1B is a sectional view illustrating an 1B-1B cross section of the column-beam junction structure according to the embodiment of the present application in FIG. 1A.

A column-beam junction structure 1 according to an embodiment of the present application will be described with reference to FIG. 1A to FIG. 3. FIG. 1A is a sectional view illustrating cross sections of the column-beam junction structure 1 according to the embodiment of the present application, which are cut in a horizontal direction. The cross section on the left of the center line is an upper 1A-1A cross section illustrated in FIG. 1B. The cross section on the right of the center line is a lower 1A-1A cross section illustrated in FIG. 1B. The right-left direction is defined as a span direction, whereas the up-down direction is defined as a ridge direction, in FIG. 1A. FIG. 1B is a sectional view illustrating an 1B-1B cross section of the column-beam junction structure 1 according to the embodiment of the present application in FIG. 1A. Note that, for clearness of the drawings, hatching of cross sections, such as of a cross section of a column 2, is partially omitted in the cross sectional drawings of the present application.

FIG. 1A illustrates an example using the column-beam junction structure 1 according to the embodiment to joint four steel beams and a concrete column 2 that is disposed as a middle column. The steel beam includes an H-section steel 3 and a beam end block 4. Each of the H-section steels 3 has an upper flange 3*a*, a web 3*b*, and a lower flange 3*c*. The H-section steel 3 has an end to which the beam end block 4 is fixed. The beam end block 4 is formed into a box shape from multiple plates. The beam end block 4 will be detailed later. The member for constituting a main part of the steel beam is not limited to an H-section steel and can use other section steel, such as an I-section steel.

The steel beam is abutted and jointed to a side surface of the column 2, in a direction substantially perpendicular to the longitudinal direction of the column 2. The four steel beams and the column 2 are jointed by using similar column-beam junction structures 1. In consideration of this, corresponding parts of the four steel beams are denoted by the same reference signs in the drawings. The column-beam junction structures 1 in the span direction and in the ridge direction are partially different from each other, and these differences will be described later. The column-beam junction structure 1 of the present application is not limitedly used in a middle column and can be used in an outer column and a corner column.

The column 2 is made of concrete and can be made of, for example, prestressed concrete or reinforced concrete. The column 2 may be formed of precast concrete or cast-in-place concrete. In short, the column 2 and the steel beam are jointed to each other after they are formed separately. The column 2 has a corbel or cogging 2*a* that is projected or overhangs from a side surface and that is used for mounting a beam end thereon. The cogging 2*a* can be integrally formed with the column 2 by using concrete. The cogging 2*a* has an upper surface, three side surfaces, and a tapered lower surface. The upper surface is substantially perpendicular to the longitudinal direction of the column 2. The side surfaces are substantially parallel to the longitudinal direction of the column 2. The lower surface is sloped in such a manner that a protrusion from the side surface of the column 2 is decreased in dimension as it goes downward. The lower surface of the cogging 2*a* is tapered in order to facilitate removal of forms or molds in manufacturing the column 2. The cogging 2*a* preferably has the above-described shape, but the shape is not limited to this and can be any shape that is configured to be mounted with a beam end. For example, the lower surface may be a horizontal surface.

A joint is provided between the beam end block 4 and the column 2, and a joint mortar 5 is interposed therebetween. Providing the joint in this manner prevents problems due to dimension errors and facilitates building.

The steel beam is tensioned and anchored to the column 2 by PC tendons 6 and anchoring devices or fasteners 7. The PC tendons 6 are arranged in such a manner as to penetrate the beam end blocks 4 and the column 2. The anchoring devices 7 are respectively disposed to both sides of the PC tendon 6. The PC tendon 6 can use a PC steel, such as a PC steel bar. In a case of using a PC steel bar, the anchoring device 7 includes a bearing plate and a nut. The anchoring device 7 tensions and anchors the PC tendon 6, in a state of being in contact with a surface of the beam end block 4 on a side opposite to the column 2. The tensioning force of the PC tendon 6 is transmitted to the beam end block 4 via the anchoring device 7, and a binding force of the PC tendon 6 is introduced to the jointed surface between the column 2 and the beam end block 4 to joint them. In a case in which the column 2 is an outer column or a corner column, an anchoring device 7 on a side on which a steel beam is not disposed, tensions and anchors a PC tendon 6, in a state of being in contact with a side surface of the column 2.

A PC tendon 6 and a pair of anchoring devices 7 constitute one set, and three sets are arranged on each side of the web 3*b*. As illustrated in FIG. 1B, in the column-beam junction structure 1 of the column 2 and the steel beams extending in the span direction, among three sets, each constituted of the PC tendon 6 and the pair of the anchoring devices 7, arranged on one side of the web 3*b*, one set is disposed at a position where the PC tendon 6 penetrates the cogging 2*a*, and two sets are disposed at positions where the PC tendons 6 penetrate portions of the column 2 above the cogging 2*a*.

Figure 2A:
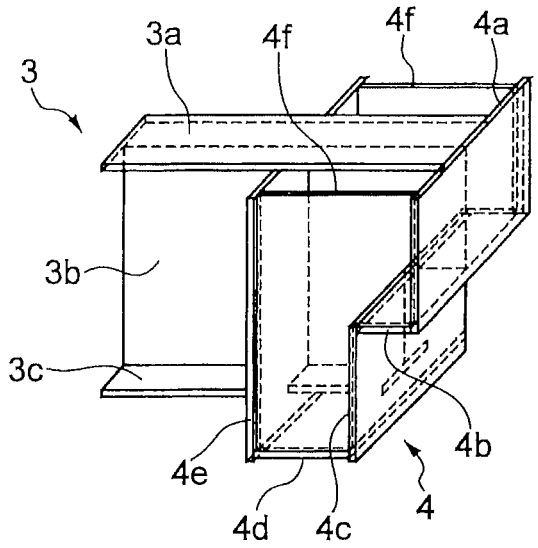
FIG. 2A is a perspective view of a beam end of the column-beam junction structure according to the embodiment of the present application.
Figure 2B:
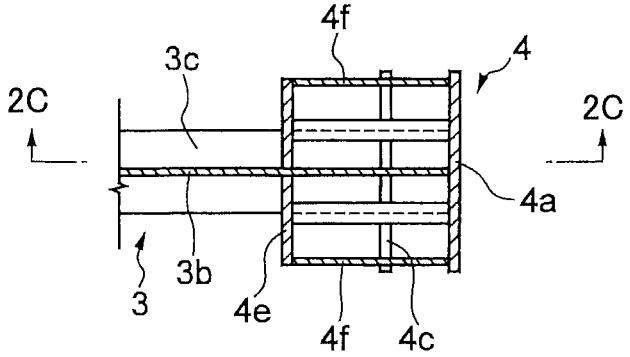
FIG. 2B is a sectional view illustrating a 2B-2B cross section of the beam end of the column-beam junction structure according to the embodiment of the present application in FIG. 2C.
Figure 2C:
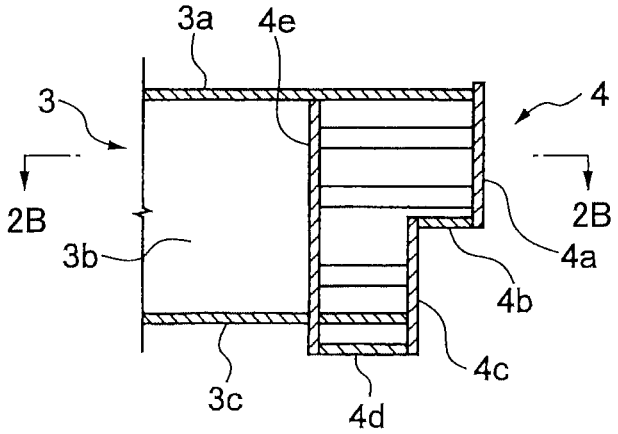
FIG. 2C is a sectional view illustrating a 2C-2C cross section of the beam end of the column-beam junction structure according to the embodiment of the present application in FIG. 2B.

FIG. 2A is a perspective view of a beam end of the column-beam junction structure 1 according to the embodiment of the present application. FIG. 2B is a sectional view of the beam end of the column-beam junction structure 1 according to the embodiment of the present application, which is cut in the horizontal direction, and FIG. 2B illustrates a 2B-2B cross section in FIG. 2C. FIG. 2C is a sectional view of the beam end of the column-beam junction structure 1 according to the embodiment of the present application, which is cut in the gravitational direction, and FIG. 2C illustrates a 2C-2C cross section in FIG. 2B.

As illustrated in FIG. 2C, in the end of the steel beam, an upper part protrudes toward the column 2 more than a lower part. That is, the upper part of the H-section steel 3 and the upper part of the beam end block 4 protrude toward the column 2 more than the respective lower parts. As illustrated in FIG. 1B, the upper part of the steel beam protruding toward the column 2 is mounted on the cogging 2*a*.

The beam end block 4 has an outer end plate 4*a*, a bed plate 4*b*, an inner end plate 4*c*, a bottom plate 4*d*, an anchor plate 4*e*, and a pair of side plates 4*f*.

The outer end plate 4*a* is made of a rectangular steel sheet and is disposed in a direction substantially perpendicular to the longitudinal direction of the H-section steel 3, in a state of being in contact with an upper end surface of the H-section steel 3 protruding toward the column 2. The outer end plate 4*a* is fixed to the upper end surface of the H-section steel 3 protruding toward the column 2, the bed plate 4*b*, and the side plates 4*f*. The outer end plate 4*a* has a dimension larger than a flange width of the H-section steel 3 in the flange width direction of the H-section steel 3. The outer end plate 4*a* preferably has a height dimension slightly larger than that of the upper part of the H-section steel 3 protruding toward the column 2, in order to facilitate welding.

The bed plate 4*b* is made of a rectangular steel sheet and is substantially horizontally disposed in contact with a lower end of the web 3*b* of the upper part of the H-section steel 3 protruding toward the column 2. The bed plate 4*b* is disposed at a position substantially the same height as a lower end of the outer end plate 4*a*. The bed plate 4*b* is fixed to the H-section steel 3, the outer end plate 4*a*, the side plates 4*f*, and the inner end plate 4*c*. The bed plate 4*b* has substantially the same dimension as the outer end plate 4*a* in the flange width direction of the H-section steel 3. The bed plate 4*b* has substantially the same dimension as the upper part of the H-section steel 3 protruding toward the column 2, in the longitudinal direction of the H-section steel 3.

The inner end plate 4*c* is made of a rectangular steel sheet and is disposed in a direction substantially perpendicular to the longitudinal direction of the H-section steel 3, in contact with a lower end surface of the H-section steel 3, under the web 3*b* protruding toward the column 2 at the end of the steel beam. The inner end plate 4*c* is fixed to the bed plate 4*b*, the lower end surface of the H-section steel 3, the bottom plate 4*d*, and the side plates 4*f*. The inner end plate 4*c* has substantially the same dimension as the outer end plate 4*a* in the flange width direction of the H-section steel 3. The inner end plate 4*c* has a height dimension larger than the length from a lower end of the upper part of the H-section steel 3 protruding toward the column 2 to the lower end of the H-section steel 3 and extends downwardly beyond the lower flange 3*c*.

The bottom plate 4*d* is made of a rectangular steel sheet and is disposed under an end of the lower flange 3*c*. The bottom plate 4*d* horizontally extends at substantially the same height as a lower end of the inner end plate 4*c*. The bottom plate 4*d* is fixed to the inner end plate 4*c*, the anchor plate 4*e*, and the side plates 4*f*. The bottom plate 4*d* has substantially the same dimension as the outer end plate 4*a* in the flange width direction of the H-section steel 3.

The anchor plate 4*e* is formed of a steel sheet and is disposed separately from the end plates 4*a* and 4*c* on a side opposite to the column 2, in a direction substantially perpendicular to the longitudinal direction of the H-section steel 3. The H-section steel 3 penetrates the anchor plate 4*e*. The anchor plate 4*e* may be formed as separate bodies, and the separate bodies may be disposed at predetermined positions and are integrally joined at both sides of the web 3*b*, respectively. The distance between the anchor plate 4*e* and each of the end plates 4*a* and 4*c* is determined in accordance with rigidity required for joining the steel beam and the column 2. The anchor plate 4*e* is fixed to the H-section steel 3, the bottom plate 4*d*, and the side plates 4*f*. The anchor plate 4*e* extends downwardly beyond the lower flange 3*c* from a lower surface of the upper flange 3*a*. A lower end of the anchor plate 4*e* is disposed at substantially the same height as the lower end of the inner end plate 4*c*.

Each of the paired side plates 4*f* is formed of a steel sheet and is disposed substantially parallel to the web 3*b* in the vicinity of an end of the outer end plate 4*a*, in the flange width direction of the H-section steel 3. The side plate 4*f* is fixed to the outer end plate 4*a*, the bed plate 4*b*, the inner end plate 4*c*, the bottom plate 4*d*, and the anchor plate 4*e*. An upper part of the side plate 4*f* has a shape protruding toward the column 2 in conformity with the end shape of the H-section steel 3.

As illustrated in FIG. 1B, a space between the end plates 4*a* and 4*c* and the anchor plate 4*e*, that is, a space inside the beam end block 4, can be filled with a filler material 8. This improves rigidity of the beam end block 4. The beam end block 4 opens upward, and therefore, it is easy to fill it with the filler material 8. The filler material 8 can use, for example, shrinkage-compensating or no-contraction mortar or concrete. Filling with the filler material 8 can be performed in a factory or in a construction site. Filling with the filler material 8 in a construction site enables reduction in weight of a steel beam in transporting the steel beam from a factory to the construction site. In a case in which the beam end block 4 has sufficiently high rigidity, filling with the filler material 8 is not necessary.

As illustrated in FIG. 1B, the height dimension of the beam end block 4 is larger than that of the H-section steel 3. A lower end of the beam end block 4 is disposed at substantially the same height as a lower end of a side surface of the cogging 2*a* that faces a lower part of the beam end block 4 or of the steel beam.

Figure 3:
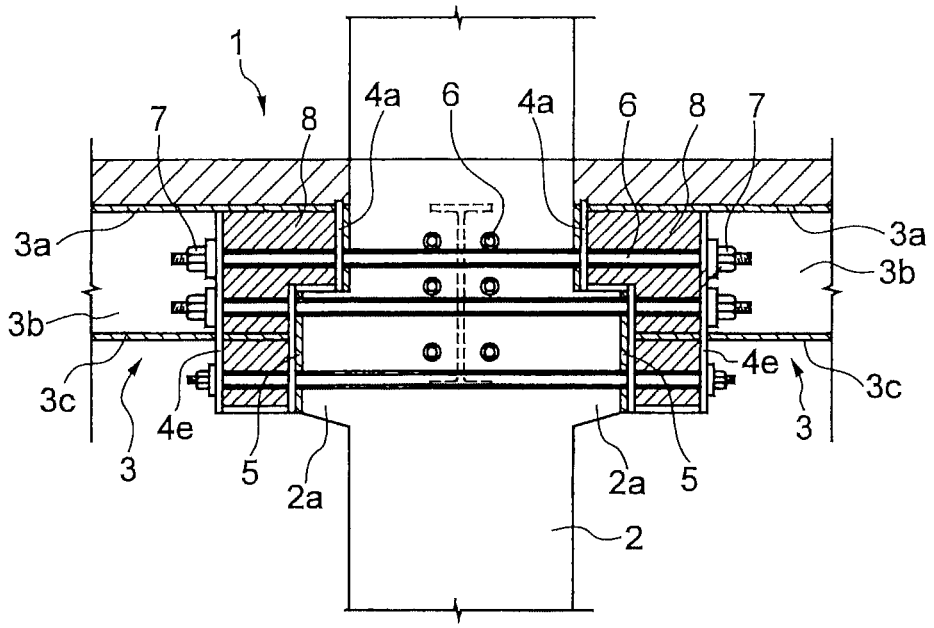
FIG. 3 is a sectional view illustrating a 3-3 cross section of the column-beam junction structure according to the embodiment of the present application in FIG. 1A.

Next, the column-beam junction structure 1 of the column 2 and a steel beam extending in the ridge direction will be described with reference to FIG. 3. FIG. 3 is a sectional view illustrating a 3-3 cross section of the column-beam junction structure 1 according to the embodiment of the present application in FIG. 1A. The column-beam junction structure 1 in the ridge direction has much in common with the column-beam junction structure 1 in the span direction. For this reason, the common parts are denoted by the same reference signs as those used in the column-beam junction structure 1 in the span direction, and duplicated description is omitted.

The H-section steel 3 of the steel beam extending in the ridge direction has a height dimension smaller than the height dimension of the H-section steel 3 of the steel beam extending in the span direction. The column-beam junction structure 1 in the ridge direction differs from the column-beam junction structure 1 in the span direction in that two PC tendons 6 penetrate the cogging 2*a* and one PC tendon 6 penetrates a part of the column 2 above the cogging 2*a*. In accordance with this structure, the cogging 2*a* is larger in the height direction than in the span direction. In addition, a part of the beam end block 4 that protrudes downwardly from the lower flange 3*c* is larger in the height direction than in the span direction. Three sets, each constituted of the PC tendon 6 and the pair of the anchoring devices 7, are arranged in the vertical direction, and all of the three sets are arranged between the upper flange 3*a* and the lower flange 3*c* in the vertical direction, in the span direction. On the other hand, the lowermost set of the PC tendon 6 and the pair of the anchoring devices 7 is disposed at a position lower than the lower flange 3*c* in the ridge direction.

The embodiment described above enables determining a cross section of a member of each of an intermediate part and the beam end block 4 of the steel beam. It is possible to constitute the beam main body or the intermediate part by using a conventional H-section steel 3 and to freely set the height dimension of the beam end block 4 in accordance with bending stress at the end of the beam and the number of the PC tendons 6. As a result, flexural rigidity can be increased by increasing the width of the beam end block 4 to be greater than the width of the steel beam, whereby the steel beam can have an economic and reasonable structure.

In consideration that bending stress due to an earthquake load is large at a beam end and that the column 2 and the steel beam are joined by PC binding juncture, it is necessary to arrange multiple PC tendons 6 in the vertical direction. In addition, the PC tendons 6 in the span direction and the PC tendons 6 in the ridge direction must be arranged in such a manner as not to mutually interfere. In view of this, in the foregoing embodiment, the height of the beam end block 4 is made larger than the height dimension of the H-section steel 3, whereby mutual interference of the PC tendons 6 is prevented while the bending stress can be withstood.

In a case in which the cross section of the H-section steel 3 constituting the steel beam can be small, the foregoing embodiment enables arranging the lowermost PC steel bar under the H-section steel 3, as in the column-beam junction structure 1 of the column 2 and the steel beam extending in the ridge direction in the foregoing embodiment. In this manner, in the case in which a necessary number of PC tendons 6 cannot be arranged without making the cross section of the H-section steel 3 larger than necessary in the whole length by a conventional technique, this situation can be coped with by enlarging only the beam end block 4 in this embodiment.

At the end of the steel beam, the upper part protrudes toward the column 2 more than the lower part and the cogging 2*a* is disposed under the protruded upper part. This allows making an installation line of a ceiling very high so as to effectively make the most of the floor height. In addition, filling the space between the anchor plate 4*e* and the end plates 4*a* and 4*c* with the filler material 8 greatly improves flexural rigidity of the beam end block 4, thereby making it possible to reduce dimensions of the beam end block 4.

Note that the invention of the present application is not limited to the foregoing embodiment and can be variously modified and altered. For example, although not illustrated, it is desirable to fill a cap that is attached to the anchoring device 7, with rust inhibitor, as rustproofing at ends of the anchoring device 7 and the PC tendon 6 that protrude from the surface of the column 2 on an outer periphery of a building. The anchoring device 7 may be covered with, e.g., shrinkage-compensating or no-contraction mortar, so as not to be exposed.

REFERENCE SINGS LIST

1: column-beam junction structure
2: column
2*a*: cogging
3: H-section steel
3*a*: upper flange
3*b*: web
3*c*: lower flange
4: beam end block
4*a*: outer end plate
4*b*: bed plate
4*c*: inner end plate
4*d*: bottom plate
4*e*: anchor plate
4*f*: side plate
5: joint mortar
6: PC tendon
7: anchoring device
8: filler material

What is claimed is:

1. A column-beam junction structure composed of a prestressed concrete (PC) column and a steel beam that are integrally jointed to each other, the steel beam including an H-section steel as a beam main body and a beam end block that is provided at an end of the H-section steel, the steel beam being disposed in a state in which the end is mounted on a cogging provided to a side surface of the column, the beam end block including an end plate and an anchor plate, the end plate being fixed at an end surface of the H-section steel in a direction substantially perpendicular to a longitudinal direction of the steel beam, the anchor plate being fixed to the H-section steel separately from the end plate, on a side opposite to the column, in the direction substantially perpendicular to the longitudinal direction of the steel beam, the end of the H-section steel including an upper part and a lower part, the upper part protruding toward the column more than the lower part and being mounted on the cogging, the end plate including an outer end plate and an inner end plate, the outer end plate being fixed at an end surface of the upper part of the H-section steel and facing the side surface of the column via a first joint, the inner end plate being fixed at an end surface of the lower part of the H-section steel and facing the cogging via a second joint, the beam end block having a height dimension larger than a height dimension of the H-section steel, the beam end block having a lower end that is disposed at substantially the same height as a lower end of a side surface of the cogging facing the lower part, the column and the beam end block being penetrated by a PC tendon, the PC tendon being tensioned and anchored to a surface on a side opposite to the column of the anchor plate to perform the integral jointing, wherein a space between the end plate and the anchor plate is filled with a filler material.

2. The column-beam junction structure according to claim 1, wherein the filler material is at least one of mortar or concrete.

* * * * *